US005246299A

United States Patent [19]

Kitsuki et al.

[11] Patent Number: 5,246,299

[45] Date of Patent: Sep. 21, 1993

[54] CASSETTE FOR THERMAL TRANSFER PRINTING FILM

[75] Inventors: Kengo Kitsuki; Kenji Sakamoto, both of Tokyo, Japan

[73] Assignee: Dai Nippon Printing Co., Ltd., Japan

[21] Appl. No.: 774,842

[22] Filed: Oct. 11, 1991

[30] Foreign Application Priority Data

Oct. 11, 1990 [JP] Japan ..... 2-106676[U]

[51] Int. Cl.[5] ..... B41J 33/52; B41J 32/00

[52] U.S. Cl. ..... 400/234; 400/208; 242/71.2

[58] Field of Search ..... 400/234, 223, 231, 236, 400/242, 246, 248, 207, 208, 208.1; 242/71.1, 71.2, 75.45

[56] References Cited

U.S. PATENT DOCUMENTS

| | | | |
|---|---|---|---|
| 4,614,949 | 9/1986 | Hakkaku et al. | 400/246 |
| 4,793,723 | 12/1988 | Furhata | 400/208 |
| 4,810,116 | 3/1989 | Schulze et al. | 400/208 |
| 4,820,067 | 4/1989 | Surti | 400/208 |
| 4,973,983 | 11/1990 | Yamamoto et al. | 400/208 |
| 4,978,240 | 12/1990 | Katsuno | 400/234 |
| 5,007,749 | 4/1991 | Falconieri | 400/208 |

FOREIGN PATENT DOCUMENTS

| | | | |
|---|---|---|---|
| 179392 | 10/1984 | Japan | 400/234 |
| 56480 | 3/1988 | Japan | 400/234 |
| 2-74378 | 3/1990 | Japan . | |

*Primary Examiner*—David A. Wiecking

*Attorney, Agent, or Firm*—Wegner, Cantor, Mueller & Player

[57] ABSTRACT

A cassette for holding a transfer printing film has a pressing member for pressing against a feed roll of the film wound around a feed reel in the cassette. When the cassette is loaded in a thermal transfer printer, the film is taken up around a take-up reel from the feed reel while the pressing member is applying a braking torque to the film on the feed reel so that torque balance is attained. When the wound length of the film of the feed roll has decreased to approximately 60 percent of the initial length, the pressing member ceases to apply the braking torque to the feed reel, and thereafter the feeding and taking up of the film are carried out in a regular torque state.

5 Claims, 2 Drawing Sheets

CASSETTE FOR THERMAL TRANSFER PRINTING FILM

BACKGROUND OF THE INVENTION

The present invention relates generally to a cassette or cartridge for housing a printing film in the form of a tape or ribbon wound around bobbins or reels, and to a method of feeding the printing film. More particularly, the invention relates to a cassette for transfer printing film to be used by loading the same into a thermal transfer printer, and to a method of feeding the printing film.

Heretofore, in order to facilitate the loading of transfer printing film into a thermal transfer printer, cassettes for transfer printing film have been widely used. Each of these cassettes accommodates a reel on the film-feed side for holding a roll of transfer printing film and another reel on the film-takeup side for winding and taking up the transfer printing film fed from the feed reel. When the cassette holding the transfer printing film is loaded into a printer, the reel on the take-up side is coupled to a driving shaft or spindle of the printer.

The transfer printing film in the cassette thus loaded is used as it is paid out or unwound from the feed reel and taken up or wound by the take-up reel. As will be described more fully hereinafter with respect to an example and in conjunction with a drawing, the diameters of the film rolls on the feed and take-up reels respectively differ considerably between the start and end of use of the film. Because of this difference, torque balance of the driving shaft of the printer cannot be maintained, whereby fluctuations in the tension of the film become large. Consequently, printing trouble such as color shifting, creasing or wrinkling, ribbing, and scoring tends to occur.

It may appear that this problem can be overcome by adjusting the driving torque on the printer side. This measure, however, is undesirable because it would complicate the printer mechanism and increase the cost.

U.S. Pat. No. 4,978,240 to Hiroshi Katsuno et al discloses a cassette for ink ribbon, having a cassette case including resilient pressing tabs for braking the feed reel. The pressing tabs are constantly in sliding contact with the reel so that torque balance can not always be obtained.

SUMMARY OF THE INVENTION

The present invention has been made in view of the above described problem. It is an object of this invention to provide a cassette for transfer printing film which, by the addition of a simple structural innovation, can accomplish good image recording when loaded into a printer. It is also an object of this invention to provide a method of feeding the transfer printing film.

According to this invention, there is provided a cassette for holding transfer printing film comprising a cassette case, feed and take-up reels rotatably supported in parallel at spaced-apart positions within the cassette case and supporting thereon a length of said transfer printing film extending therebetween and wound respectively therearound in the form of a feed roll and a take-up roll, and a pressing member supported by the cassette case so as to press against said feed roll to apply thereto a braking force during an initial part of the film feeding operation thereof.

According to this invention, there is further provided a method of feeding a transfer printing film extending between and wound around feed and take-up reels in a film cassette loaded into a printer, said method comprising the step of rotating the take-up reel to draw out the printing film from the feed reel and to wind the film around the take-up reel, while causing a pressing member to press against a feed roll of the film on the feed reel to apply a braking force to the feed reel, and causing the pressing member to cease to press against the feed roll when the diameter of the feed roll has decreased to a predetermined diameter, thereby to carry out the feeding and taking up of the film in a regular torque state.

DESCRIPTION OF THE PREFERRED EMBODIMENTS

Figure 7:
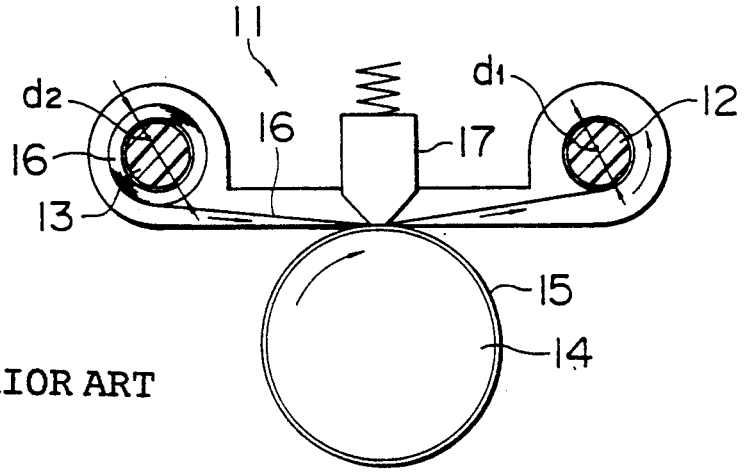
PRIOR ART FIG. 7
FIG. 7 is a simplified side view, partly in section, showing a cassette for transfer film of the prior art, the cassette being shown in a state wherein it has been loaded in a printer and has just started image recording.
Figure 8:
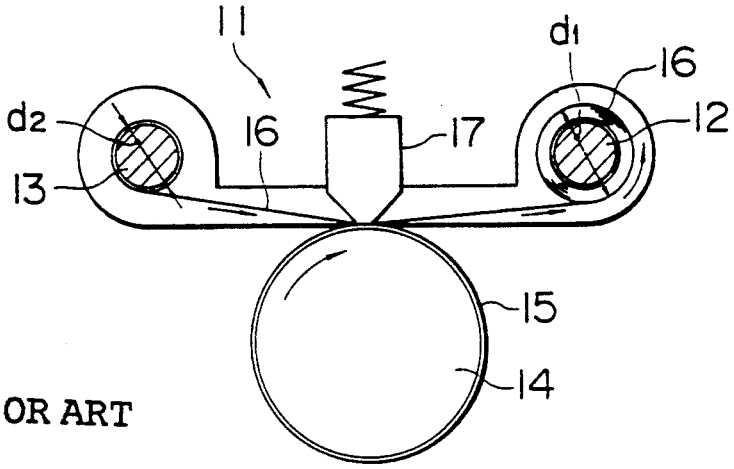
PRIOR ART FIG. 8
FIG. 8 is a view similar to FIG. 7, showing the same cassette in its state at the end of image recording.

As conducive to a full understanding of the present invention, the general nature, attendant problems, and limitations of the prior art relating to cassettes for thermal transfer printing film will first be considered with respect to a typical example thereof as illustrated in FIGS. 7 and 8.

In FIG. 7, the example of a known cassette 11 for transfer printing film is shown in its loaded state in a printer in readiness for image recording. In the loaded state of the cassette 11 as shown, its reel 12 on the take-up side is coupled to a driving shaft (not shown) of the printer. At the same time, the recording part of a transfer printing film 16 accommodated in the cassette 11 between its feed reel 13 and take-up reel 12 is pressed by a thermal head 17 against an image-receiving sheet, or sheet to be printed 15, held around the cylindrical peripheral surface of a platen roller 14.

Then, with the above described parts in the state shown, the platen roller 14 is rotated in the arrow direction. In synchronism with this rotation, the take-up reel 12 is rotated in the arrow direction by the above mentioned driving shaft. Accordingly, the transfer printing film 16 is continuously drawn out from the feed reel 13. In this manner, image recording on the print sheet 15 is carried out.

In the case of image recording in the above described manner, the film roll diameter $d_1$ of the transfer printing film 16 taken up on the take-up reel 12 is small at the time of the start of use of the film 16 as indicated in FIG. 7. As the take-up winding proceeds, the film roll diameter $d_1$ progressively increases until, at the time of the end of use of the film 16, it becomes large as indicated in FIG. 8. Conversely, the roll diameter $d_2$ of the transfer printing film 16 on the feed reel 13 is large at the start of use of the film 16 and becomes small at the end of use of the film 16.

Thus, the roll diameters at the two reels differ greatly between the start and end of use of the transfer printing film. Because of this difference, the torque balance of the driving shaft of the printer cannot be maintained, and fluctuations of the tension in the transfer printing film 16 become large. Consequently, printing trouble, such as color shifting, wrinkling and creasing, and ribbing or scoring, becomes a problem.

As a measure for overcoming this problem, adjustment of the driving torque on the printer side may seem to be possible. However, this measure is not desirable since it would complicate the mechanism of the printer and would increase the cost.

The present invention succeeds in overcoming this problem with a simple modification of the case of the transfer printing film cassette.

Figure 1:
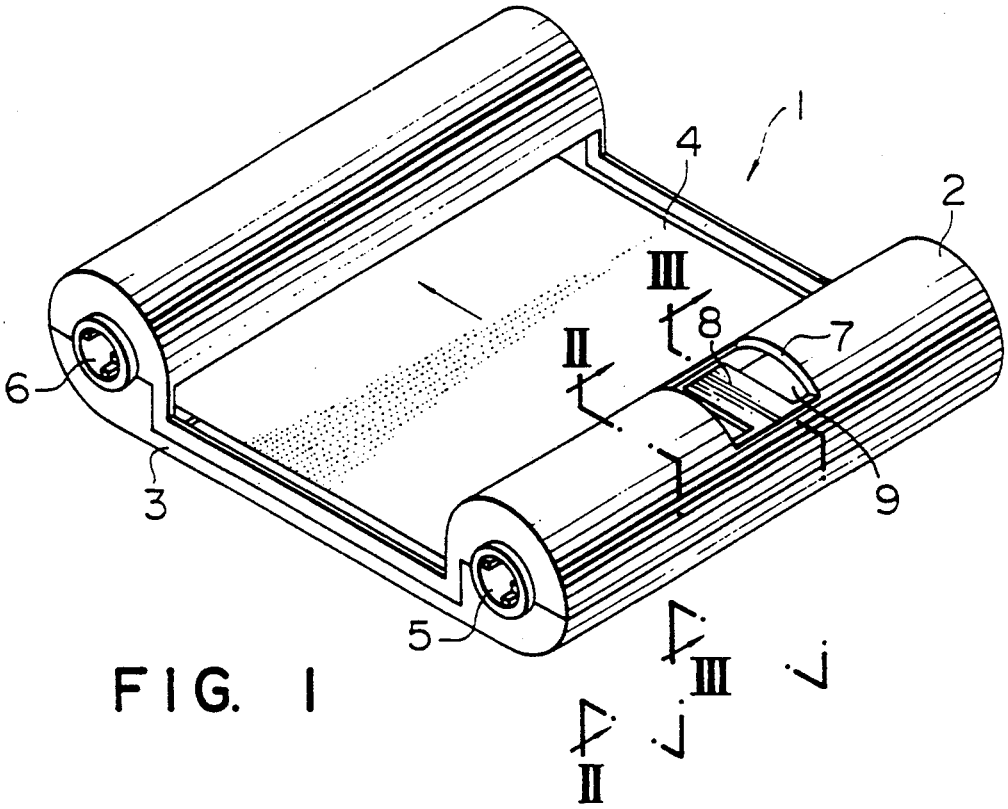
FIG. 1 is a perspective view showing a cassette for a transfer printing film according to this invention, the cassette being shown in its state prior to use.

Referring to FIG. 1 illustrating an embodiment of the invention, the cassette 1 for transfer printing film has a cassette case formed by an upper case part 2 and a lower case part 3, both fabricated of a plastic or synthetic resin. Within the cassette case, at opposite ends thereof, are respectively housed a feed reel 5 holding a roll of transfer printing film 4 and a take-up reel 6 for winding up the film 4.

Figure 2:
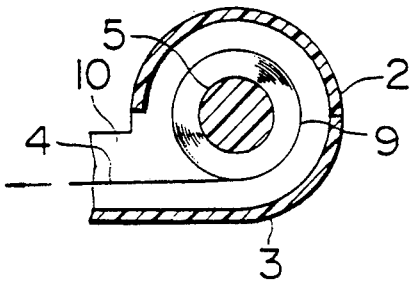
FIG. 2 is a partial sectional view taken along the plane II—II in FIG. 1.

When the upper and lower case parts 2 and 3 are assembled to form the cassette case, they simultaneously form two cylindrical chambers for accommodating respectively the feed and take-up reels 5 and 6 at a specific spacing distance. At the same time, eight semicircular cutouts in the opposite lateral walls of the upper and lower case parts 2 and 3, at their portions forming the ends of the above mentioned cylindrical chambers, are brought together to form four circular openings at opposite ends of the cylindrical chambers. The rims of these four cylindrical openings constitute bearing parts for rotatably supporting the end spindle or journal parts of the feed and take-up reels 5 and 6. As shown in FIG. 2, the two cylindrical chambers are provided on their mutually facing sides with slots 10 extending in parallel to the axes of the cylindrical chambers. These slots 10 permit the passage therethrough of the transfer printing film 4 when it is being paid out and taken up respectively by the feed and take-up reels 5 and 6.

Figure 3:
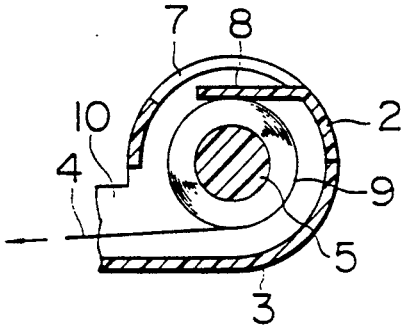
FIG. 3 is a partial sectional view taken along the plane III—III in FIG. 1.

As shown in FIG. 1, a window or opening 7 is formed in the semicylindrical part of the upper case part 2 for forming the cylindrical chamber for accommodating the feed reel 5. This opening 7 is thus formed at approximately the middle of semicylindrical part as considered in the lateral direction thereof. From one edge of this opening 7, that is, the edge most remote from the take-up reel 6, a pressing tab 8 is formed to extend toward the side of the take-up reel 6. As most clearly shown in FIG. 3, the pressing tab 8 has the property of an elastic cantilever beam and functions through its elastic force in bending to press against and hold a film roll 9 of the transfer printing film 4 supported on the feed reel 5. The pressing tab 8 is advantageously formed integrally with the upper case part 2 at the time of fabrication thereof, particularly when the opening 7 is cut out.

The cassette case including the pressing tab 8 is preferably made of a synthetic resin, such as polystylen, ABS resin, polyphenylether and polycarbonate.

A lubricant for mold releasing may be added to the material of the cassette case before the molding. The lubricant is selected from the group consisting of a higher fatty acid such as oleic acid and stearic acid, a salt of such fatty acid, a silicone such as alcohol modified silicone oil and polymethysyloxane, molybdenum disulfide and graphite. The silicone is preferably added in an amount from 0.1 to 0.5 percent by weight. Below 0.1 percent the effect of the lubricant will be low, while above 5.0 percent dust tends to adhere to the surface of the molded cassette case. The higher fatty acid or its salt may preferably be added in an amount from 0.1 to 3.0 percent by weight. If the added amount is insufficient, the effect of the lubricant will of course be small, while too much amount is added, the strength of the molded cassette will be lower because of low compatibility with synthetic resin. Molybdenum disulfide and graphite may preferably be added in an amount from 0.5 to 5 percent by weight. Below 0.5 percent there will be a little effect, while above 5 percent the cassette case will have low strength and become brittle.

The cassette 1 having the above described construction and holding a transfer printing film 4 wound mostly around the feed reel 5 and wound to an extent necessary at its leading end around the take-up reel 6 is loaded into a printer (not shown). Then, when the take-up reel 6 is driven, the roll diameter of the transfer printing film 4 on the take-up reel 6 is relatively small at the start of use of the film 4. For this reason, the force for taking up the film 6 is great. However, since the pressing tab 8 is in a state wherein it is pressing against the outer peripheral surface of the film roll 9, a braking torque is applied to the feed reel 5. As a result, excessive feeding of the film 4 is prevented, whereby slack in the film 4 does not arise.

Figure 4:
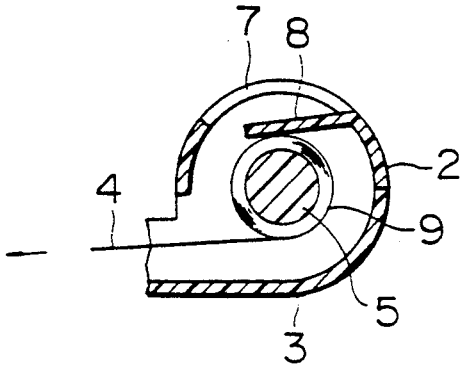
FIG. 4 is a view similar to FIG. 3 but showing a state different from that of FIG. 3.

Then, when a number of initial frames of images on the transfer printing film 4 have been paid out, the pressing tab 8 is in a state just before it is separated from the film roll 9 as indicated in FIG. 4. Accordingly, feeding and taking up of the film 4 are carried out in a regular torque state. Thus, when the diameter of the take-up film roll on the take-up reel 6 is small, and the take-up force is great, the pressing tab 8 is pressing against the film roll 9 on the feed reel 5. Therefore, the torque balance between the feeding and taking up of the film 4 is preserved. The pressing tab 8 is preferably so formed to separate from the film roll 9 when the number of the frames of images on the film 4 around the feel reel 5 have decreased to approximately 60 percent of the number of the frames on the film at the time of start of the unwinding of the film 4, in other words, when the length of the film roll 9 on the feed reel 5 has decreased to approximately 60 percent of the maximum film length of the roll 9 at the time of start of the unwinding of the film 4. Approximately 60 percent of the film length corresponds to about 77% of the maximum diameter of the film roll 9 at the time of start of the unwinding.

Figure 5:
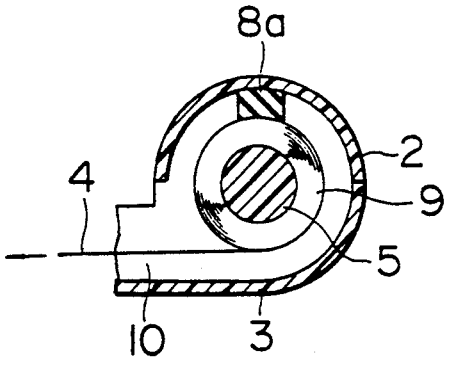
FIG. 5 is a view similar to FIG. 3 but showing a modified form.
Figure 6:
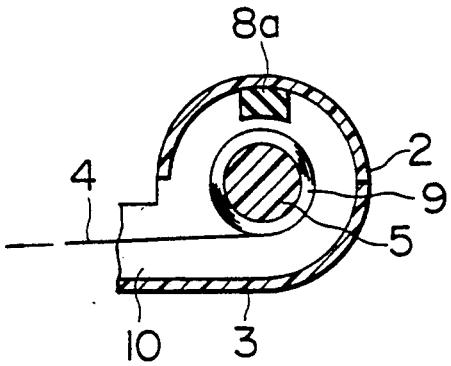
FIG. 6 is a view similar to FIG. 5 but showing a state different from that of FIG. 5.

FIGS. 5 and 6 show another embodiment of the invention. In this embodiment the upper case part 2 does not have an opening 7, and instead of the pressing tab 8 there is provided a pressing member **8*a* which is a block-shaped yieldable material made of an elastic rubber, for example. The pressing member 8*a* is, for example, adhesively secured to the inner surface of the upper case part 2**.

When the film roll 9 is first loaded with its maximum diameter in the cassette case, the pressing member **8*a* is in a state compressed radially outwardly by the film roll 9, whereby when the transfer printing film 4 is paid out, a braking torque is applied to the feed reel 5. As a result, excessive feeding of the film 4 is prevented so that slack in the film 4 does not arise. As the film 4 is paid out to such an extent that the remaining length of the film roll 9 decreases to approximately 60 percent of the initial full length of the roll, the outer surface of the roll 9 is separated from the pressing member 8***a* which has expanded to a maximum dimension whereby the braking torque disappears so that feeding and taking up of the film 4 are carried out in a regular torque state.

As described above, the cassette for transfer printing film according to the present invention has the following advantageous features. A pressing member is provided to press against the film roll supported on the feed reel. A braking force thereby acts on the feed reel at the start of use of the transfer printing film. Therefore the torque balance during feeding and taking up of the film is maintained. As a result, fluctuations in the tension applied to the film are reduced, and good image recording is accomplished.

Furthermore, the pressing tab is formed integrally with the cassette case at the time of fabrication thereof and does not require addition material. Moreover, the pressing member is a mere block of elastic material attached to the cassette case. Therefore the cassette of this invention can be fabricated simply and at low cost.

It is to be understood that the principle of the invention may equally be applied to a transfer printing other than thermal transfer printing.

What is claimed is:

1. A cassette for holding a transfer printing film comprising:

a cassette case;

an elongated feed reel and an elongated take-up reel rotatably supported in parallel at spaced-apart positions within the cassette case and supporting thereon a length of a transfer printing film extending therebetween and wound respectively thereround to form an elongated feed roll and an elongated take-up roll of said film on said feed reel and take-up reel, respectively, said feed roll having a maximum diameter before said take-up reel starts taking up of the film thereonto; and an elastically deformable pressing member provided on said cassette case so as to confront a middle portion of an outer surface of said feed roll with respect to the longitudinal direction of the feed roll said pressing member having a non-deformed state in which the pressing member is in light contact with said outer surface of the feed roll which has a specific diameter smaller than said maximum diameter, said pressing member being elastically deformed radially outwardly of said feed reel to press against said feed roll to apply to braking force thereto when the feed roll has a diameter between said maximum diameter and said specific diameter, said pressing member ceasing to apply the braking force to the feed roll when the film is paid out from the feed roll so that the feed roll has a diameter smaller than said specific diameter.

2. The cassette for holding a transfer printing film as claimed in claim 1, wherein said specific diameter of the feed roll is a diameter at which the length of the film of said feed roll at said maximum diameter decreases to approximately 60 percent thereof by the taking up of the film on said take-up reel.

3. The cassette for holding a transfer printing film as claimed in claim 1, wherein said pressing member is a tab in the form of an elastically deflectable cantilever fixed at one end thereof to the cassette case and extending at the other end into said case to confront said feed roll.

4. The cassette for holding a transfer printing film as claimed in claim 3, wherein said cassette case has a cutout opening with an edge, and said elastically deflectable cantilever is fixed to said edge.

5. The cassette for holding a transfer printing film as claimed in claim 1, wherein said pressing member is a block of an elastic material secured to an inner surface of the cassette case.

* * * * *